US008573327B2

(12) United States Patent
Trinh et al.

(10) Patent No.: US 8,573,327 B2
(45) Date of Patent: Nov. 5, 2013

(54) APPARATUS AND METHODS FOR ESTIMATING TOOL INCLINATION USING BIT-BASED GAMMA RAY SENSORS

(75) Inventors: Tu Tien Trinh, Houston, TX (US); Eric Sullivan, Houston, TX (US); Xiaomin C. Cheng, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 248 days.

(21) Appl. No.: 13/088,942

(22) Filed: Apr. 18, 2011

(65) Prior Publication Data

US 2011/0253446 A1 Oct. 20, 2011

Related U.S. Application Data

(60) Provisional application No. 61/325,436, filed on Apr. 19, 2010.

(51) Int. Cl.
*E21B 47/01* (2012.01)

(52) U.S. Cl.
USPC ..... 175/45; 175/50

(58) Field of Classification Search
USPC ..... 175/40, 45, 50
See application file for complete search history.

(56) References Cited

U.S. PATENT DOCUMENTS

| | | | |
|---|---|---|---|
| 5,415,030 | A | 5/1995 | Jogi et al. |
| 5,448,227 | A | 9/1995 | Orban et al. |
| 5,475,309 | A | 12/1995 | Hong et al. |
| 5,720,355 | A | 2/1998 | Lamine et al. |
| 5,969,359 | A | 10/1999 | Ruddy et al. |
| 6,057,784 | A | 5/2000 | Schaaf et al. |
| 6,150,822 | A | 11/2000 | Hong et al. |
| 6,230,822 | B1 | 5/2001 | Sullivan et al. |
| 6,419,032 | B1 | 7/2002 | Sullivan et al. |
| 6,540,033 | B1 | 4/2003 | Sullivan et al. |
| 6,543,312 | B2 | 4/2003 | Sullivan et al. |
| 6,564,883 | B2 | 5/2003 | Fredericks et al. |
| 6,571,886 | B1 | 6/2003 | Sullivan et al. |
| 6,626,251 | B1 | 9/2003 | Sullivan et al. |
| 6,769,497 | B2 | 8/2004 | Dubinsky et al. |
| 6,850,068 | B2 | 2/2005 | Chemali et al. |
| 7,046,165 | B2 | 5/2006 | Beique et al. |
| 7,058,512 | B2 | 6/2006 | Downton |

(Continued)

FOREIGN PATENT DOCUMENTS

EP 1431510 A2 6/2004

OTHER PUBLICATIONS

Dateline Los Almos, a Monthly Publication of Los Almos National Laboratory, Jan. Issue 1997, pp. 1-8.

*Primary Examiner* — William P Neuder
(74) *Attorney, Agent, or Firm* — Cantor Colburn LLP

(57) ABSTRACT

A drill bit made according to one embodiment may include a bit body having a longitudinal axis, a plurality of gamma sensors placed in the bit body, at least two gamma ray sensors in the plurality of sensors are spaced-apart from each other along the longitudinal axis of the bit body, wherein each such sensor in the plurality of sensors is configured to detect gamma rays from the formation during drilling of the wellbore and to provide signals representative of the detected gamma rays, and a circuit configured to process at least partially the signals from each of the at least two gamma ray sensors for estimating an inclination of the bit body relative to the longitudinal axis.

25 Claims, 4 Drawing Sheets

(56) References Cited

U.S. PATENT DOCUMENTS

| | | | | |
|---|---|---|---|---|
| 7,066,280 | B2 | 6/2006 | Sullivan et al. | |
| 7,207,215 | B2 | 4/2007 | Spross et al. | |
| 7,278,499 | B2 | 10/2007 | Richert et al. | |
| 7,308,937 | B2 | 12/2007 | Radford et al. | |
| 7,350,568 | B2 | 4/2008 | Mandal et al. | |
| 7,387,177 | B2 | 6/2008 | Zahradnik et al. | |
| 7,398,837 | B2 * | 7/2008 | Hall et al. | 175/50 |
| 7,497,276 | B2 | 3/2009 | Pastusek et al. | |
| 7,506,695 | B2 | 3/2009 | Pastusek et al. | |
| 7,510,026 | B2 | 3/2009 | Pastusek et al. | |
| 7,763,845 | B2 | 7/2010 | Estes et al. | |
| 7,987,925 | B2 * | 8/2011 | Pastusek et al. | 175/50 |
| 2001/0054514 | A1 | 12/2001 | Sullivan et al. | |
| 2004/0069539 | A1 | 4/2004 | Sullivan et al. | |
| 2004/0222018 | A1 | 11/2004 | Sullivan et al. | |
| 2007/0114062 | A1 | 5/2007 | Hall et al. | |
| 2007/0186639 | A1 | 8/2007 | Spross et al. | |
| 2008/0060848 | A1 | 3/2008 | Pastusek et al. | |
| 2008/0065331 | A1 | 3/2008 | Pastusek et al. | |
| 2008/0066959 | A1 | 3/2008 | Pastusek et al. | |
| 2008/0164062 | A1 | 7/2008 | Brackin et al. | |
| 2010/0089645 | A1 | 4/2010 | Trinh et al. | |

* cited by examiner

APPARATUS AND METHODS FOR ESTIMATING TOOL INCLINATION USING BIT-BASED GAMMA RAY SENSORS

CROSS-REFERENCES TO RELATED APPLICATIONS

This application claims priority from the U.S. Provisional Patent Application having Ser. No. 61/325,436 filed Apr. 19, 2010.

BACKGROUND INFORMATION

1. Field of the Disclosure

This disclosure relates generally to drill bits that include sensors for providing measurements relating to detection of gamma rays from formations.

2. Brief Description of the Related Art

Oil wells (wellbores) are usually drilled with a drill string that includes a tubular member having a drilling assembly (also referred to as the bottomhole assembly or "BHA") with a drill bit attached to the bottom end thereof. The drill bit is rotated to disintegrate the earth formations to drill the wellbore. The BHA includes devices and sensors for providing information about a variety of parameters relating to the drilling operations, behavior of the BHA and formation surrounding the wellbore being drilled (formation parameters). A variety of sensors, such as inclinometers and/or gyroscopes placed in the BHA, are utilized for determining the inclination or tilt of the BHA. Such sensors are positioned a certain distance from the drill bit in the BHA and may not provide accurate tilt or inclination of the drill bit during drilling of the wellbore.

The disclosure herein provides bit-based gamma ray sensors for determining tilt of the drill bit and thus that of the wellbore during drilling of the wellbore.

SUMMARY

In one aspect, the present disclosure provides a drill bit that, according to one embodiment, includes a bit body having a longitudinal axis, a plurality of spaced-apart sensors placed in the bit body and configured to detect gamma rays from a formation during drilling of a wellbore in the formation and to provide signals representative of the detected gamma rays, and a circuit configured to process at least partially the signals from the sensors for estimating an inclination of the bit body relative to the longitudinal axis.

In another aspect, the present disclosure provides a method for estimating inclination of a drill bit or BHA during drilling of a wellbore. The method, in one embodiment, may include drilling a wellbore, measuring gamma ray radiations at a plurality of spaced apart locations on the drill bit, and determining an inclination of the drill bit or BHA using the measured gamma rays.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DESCRIPTION OF THE DISCLOSURE

The present disclosure relates to devices and methods that utilize gamma ray sensors in a drill bit to detect naturally-occurring gamma rays in a formation and estimating from such measurements an inclination of the drill bit during drilling of a wellbore. The present disclosure is susceptible to embodiments of different forms. The drawings show and the written specification describes specific embodiments of the present disclosure with the understanding that the present disclosure is to be considered an exemplification of the principles of the disclosure, and is not intended to limit the disclosure to that illustrated and described herein.

Figure 1:
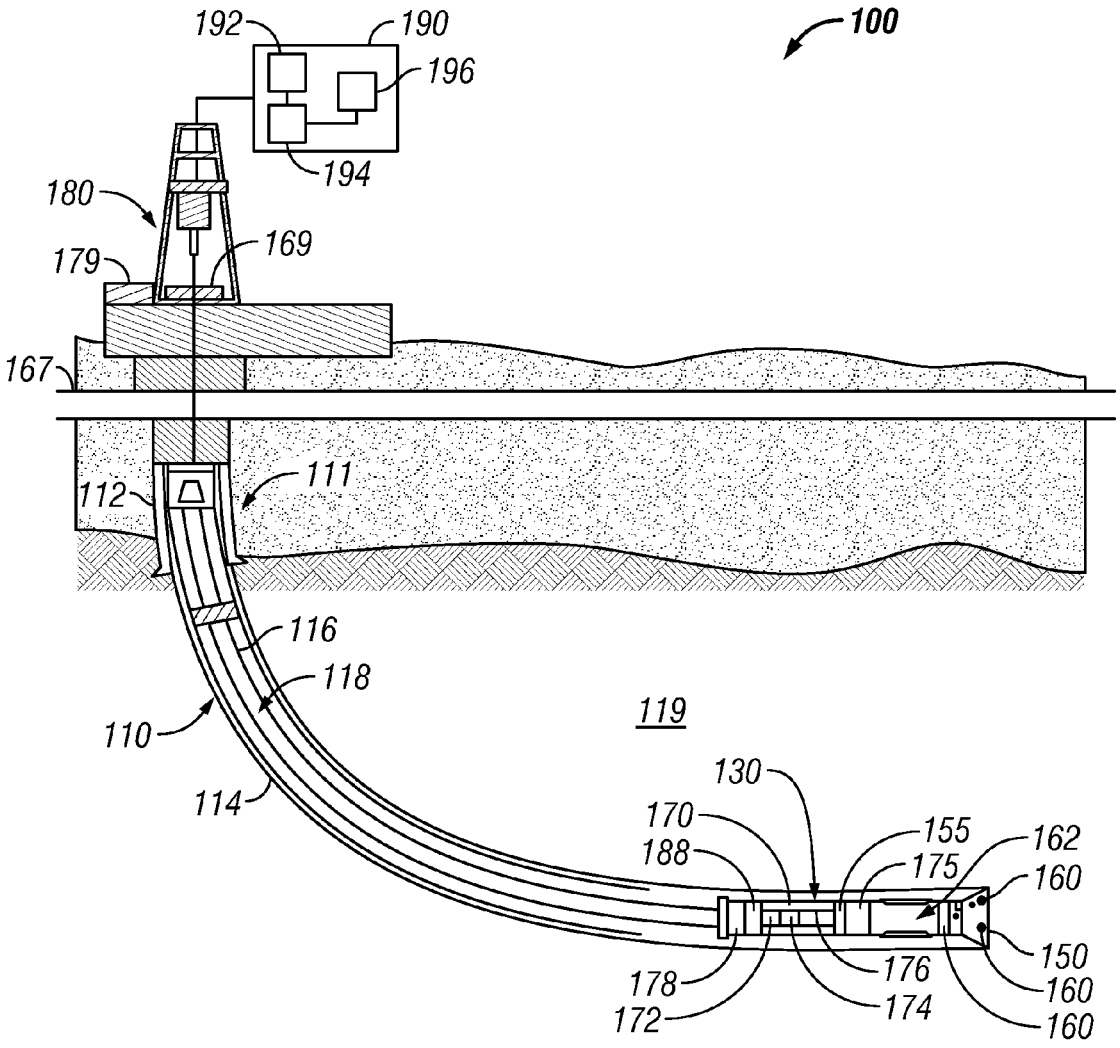
FIG. 1 is a schematic diagram of a drilling system that includes a drill string with a drill bit made according to one embodiment of the disclosure for drilling wellbores.

FIG. 1 is a schematic diagram of an exemplary drilling system 100 that may utilize drill bits disclosed herein for drilling wellbores. FIG. 1 shows a wellbore 110 that includes an upper section 111 with a casing 112 installed therein and a lower section 114 that is being drilled with a drill string 118. The drill string 118 includes a tubular member 116 that carries a drilling assembly 130 (also referred to as the bottomhole assembly or "BHA") at its bottom end. The tubular member 116 may be made by joining drill pipe sections or it may be a coiled tubing. A drill bit 150 is attached to the bottom end of the BHA 130 for disintegrating the rock formation to drill the wellbore 110 of a selected diameter in the formation 119. Not shown are devices such as thrusters, stabilizers, centralizers, and devices such as steering units for steering the drilling assembly 130 in a desired direction. The terms wellbore and borehole are used herein as synonyms.

The drill string 118 is shown conveyed into the wellbore 110 from a rig 180 at the surface 167. The exemplary rig 180 shown in FIG. 1 is a land rig for ease of explanation. The apparatus and methods disclosed herein may also be utilized with rigs used for drilling offshore wellbores. A rotary table 169 or a top drive (not shown) coupled to the drill string 118 at the surface may be utilized to rotate the drill string 118 and thus the drilling assembly 130 and the drill bit 150 to drill the wellbore 110. A drilling motor 155 (also referred to as "mud motor") may also be provided to rotate the drill bit. A control unit (or controller) 190, which may be a computer-based unit, may be placed at the surface 167 for receiving and processing data transmitted by the sensors in the drill bit and other sensors in the drilling assembly 130 and for controlling selected operations of the various devices and sensors in the drilling assembly 130. The surface controller 190, in one embodiment, may include a processor 192, a data storage device (or a computer-readable medium) 194 for storing data and computer programs 196. The data storage device 194 may be any suitable device, including, but not limited to, a read-only memory (ROM), a random-access memory (RAM), a flash memory, a magnetic tape, a hard disc and an optical disk. To drill a wellbore, a drilling fluid from a source 179 is pumped under pressure into the tubular member 116. The drilling fluid discharges at the bottom of the drill bit 150 and returns to the surface via the annular space (also referred as the "annulus") between the drill string 118 and the inside wall of the wellbore 110.

Still referring to FIG. 1, the drill bit 150 includes two or more gamma ray sensors 160 in the drill bit for detecting naturally-occurring gamma rays from the formation 119 during drilling of the wellbore 110. Naturally-occurring gamma rays are gamma rays that are not induced by a source and may also be referred to as passive gamma rays. In one aspect, at least two gamma ray sensors are placed proximate or very close to the formation and in a common plane perpendicular or substantially perpendicular to the drill bit longitudinal axis or BHA longitudinal axis 162. The drilling assembly 130 may further include one or more downhole sensors (also referred to as the measurement-while-drilling (MWD) sensors and collectively designated by numeral 175) and at least one control unit (or controller) 170 for processing data received from the MWD sensors 175 and the drill bit 150. The controller 170 may include a processor 172, such as a microprocessor, a data storage device 174 and a program 176 for use by the processor 172 to process downhole data and to communicate data with the surface controller 190 via a two-way telemetry unit 188. The telemetry unit 188 may utilize communication uplinks and downlinks. Exemplary communications methods may include mud pulse telemetry, acoustic telemetry, electromagnetic telemetry, and one or more conductors (not shown) positioned along the drill string 118. The data conductors may include metallic wires, fiber optical cables or other suitable data carriers. A power unit 178 provides power to the electrical sensors and circuits in the drill bit 150 and the BHA. In one embodiment, the power unit 178, may include a turbine driven by the drilling fluid and an electrical generator. Batteries may be utilized to provide power to circuits in the drill bit 150.

The MWD sensors 175 may include sensors for measuring near-bit direction (e.g., BHA azimuth and inclination, BHA coordinates, etc.), dual rotary azimuthal gamma ray, bore and annular pressure (flow-on & flow-off), temperature, vibration/dynamics, multiple propagation resistivity, and sensors and tools for generating rotary directional surveys. Exemplary sensors may also include sensors for determining parameters of interest relating to the formation, borehole, geophysical characteristics, borehole fluids and boundary conditions. These sensors include formation evaluation sensors (e.g., resistivity, dielectric constant, water saturation, porosity, density and permeability), sensors for measuring borehole parameters (e.g., borehole size and borehole roughness), sensors for measuring geophysical parameters (e.g., acoustic velocity and acoustic travel time), sensors for measuring borehole fluid parameters (e.g., viscosity, density, clarity, rheology, pH level, and gas, oil and water contents), boundary condition sensors, and sensors for measuring physical and chemical properties of the borehole fluid. Details of the use of the gamma ray sensors in the drill bit to determine tilt or inclination are described in more detail in reference to FIGS. 2-4.

Figure 2:
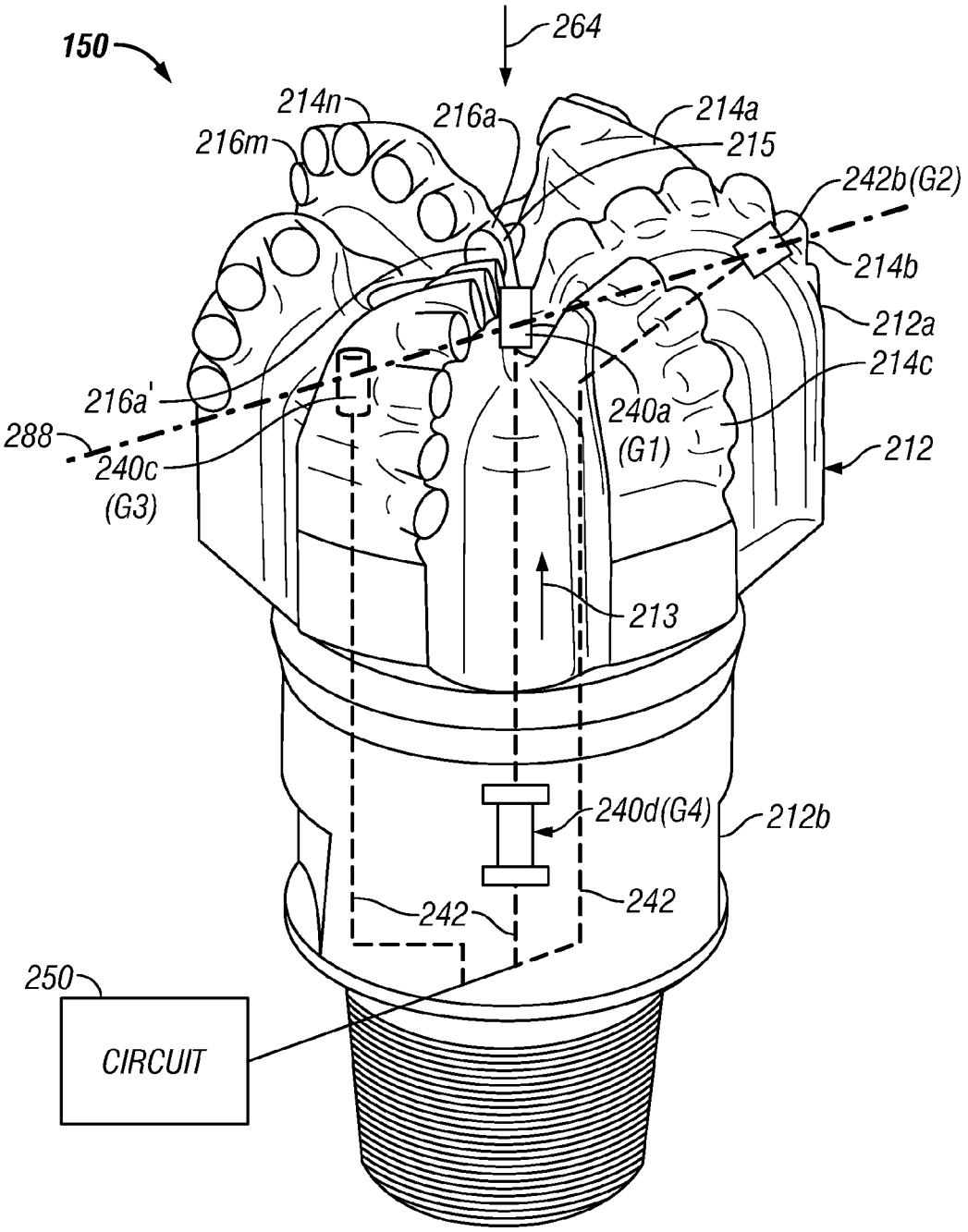
FIG. 2 is an isometric view of an exemplary drill bit showing placement of a gamma ray sensor in the drill bit and an electrical circuit for at least partial processing of the signals generated by the gamma ray sensor according to one embodiment of the disclosure.

FIG. 2 shows an isometric view of an exemplary drill bit 150. The drill bit 150 shown is a PDC (polycrystalline diamond compact) drill bit and is shown for explanatory purposes. Any other type of drill bit may be utilized for the purpose of this disclosure. The drill bit 150 is shown to include a drill bit body 212 comprising a cone 212*a* and a shank 212*b*. The cone 212*a* includes a number of blade profiles (or profiles) 214*a*, 214*b*, . . . 214*n*. A number of cutters are placed along each profile. For example, profile 214*n* is shown to contain cutters 216*a*-216*m*. All profiles are shown to terminate at the bottom 215 of the drill bit 150. Each cutter has a cutting surface or cutting element, such as element 216*a*' of cutter 216*a*, that engages the rock formation when the drill bit 150 is rotated during drilling of the wellbore. FIG. 2 illustrates a variety of positions or locations for the gamma ray sensors. In one arrangement, a gamma ray sensor 240*a* (G1) may be placed on the face 264, gamma ray sensors 240*b* (G2) and 240*c* (G3) on opposite sides on the cone 212*a*, gamma ray sensor 240*d* (G4) in the shank 212*b*. Also, such gamma ray sensors may be placed at any suitable location in the drill bit 150. In one embodiment at least two gamma ray sensors are placed on a common or substantially common horizontal plane, i.e., a plane substantially perpendicular to the longitudinal axis 260 of the drill bit 150. In such an embodiment, sensors are situated on a common plane parallel to the face 264 of the drill bit, such as the plane shown by line 288. In FIG. 2, sensors G1, G2 and G3 are in the common plane 288. In one aspect, the sensors G1, G2 and G3 may be placed such that they contact the formation. Such a location of the gamma ray sensors may provide maximum or substantially maximum detection of naturally-occurring gamma rays. During drilling, these sensors detect gamma rays from the formation and the drilling fluid in contact with or proximate these gamma ray sensors. In one aspect, the gamma ray sensor G4 may be placed in a manner such that it detects only, or substantially only, the gamma rays from the drilling fluid 213 passing through the bore 232 in the drill bit. G4 sensor measurements may be utilized to normalize the measurement of the sensors G1-G3, such as by subtracting the G4 measurements from these other sensor measurement. Reducing the gamma rays detected by the sensors G1-G3 by the gamma rays detected by G4 provides gamma rays of the formation. The gamma ray sensors G1-G4 detect gamma rays and provide signals representative of the detected gamma rays. Conductors 242 provide signals from the sensors to a circuit 250 for processing. The circuit 250 or a portion thereof may be placed in the drill bit 150 or outside the drill bit. One arrangement for the placement of the circuit is described in reference to FIG. 3. The circuit 250, in one aspect, amplifies signals from the sensor 240 and processes such signals to provide information useful for determining the inclination, as described in more detail in reference to FIG. 4. The sensors G1-G3 may be positioned at a surface of the bit body 150. If sensing elements of the sensors are recessed into the bit body 150, then a window, such as 240*a* (G1) may be formed of a media that is transparent to gamma radiations may be interposed between the sensing element and the formation.

Any suitable gamma ray sensor may be utilized for the purpose of this disclosure. In one aspect, the gamma ray sensor may include a scintillation crystal (scintilator), such as a sodium iodide (NaI) crystal, optically coupled to a photomultiplier tube. Output signals from the photomultiplier tube may be transmitted to the circuit 250, which may include pre-amplification and amplification circuits. The amplified sensor signals may be processed by a processor in the circuit 250 and/or transmitted to the processor 172 (FIG. 1). In certain applications, scintillation gamma ray detectors, such as those incorporating NaI, may not be suitable due to their size and because they include photomultiplier tubes. Accordingly, in certain embodiments of the disclosure, solid state devices for gamma ray detection may be utilized. An example of such a device is shown in U.S. Pat. No. 5,969,359 to Ruddy et al. Solid state detectors are relatively small and may be oriented in any direction in the drill bit. Another embodiment of the disclosure uses a photodiode with a long-wavelength cutoff in the short-wavelength range possessing reduced temperature sensitivity. It may be matched with scintillation devices having an output matched to the response curve of the photodiode. Such a device is disclosed in U.S. Pat. No. 7,763,845 to Estes et al., having the same assignee as the present disclosure and the contents of which are incorporated herein by reference.

Figure 3:
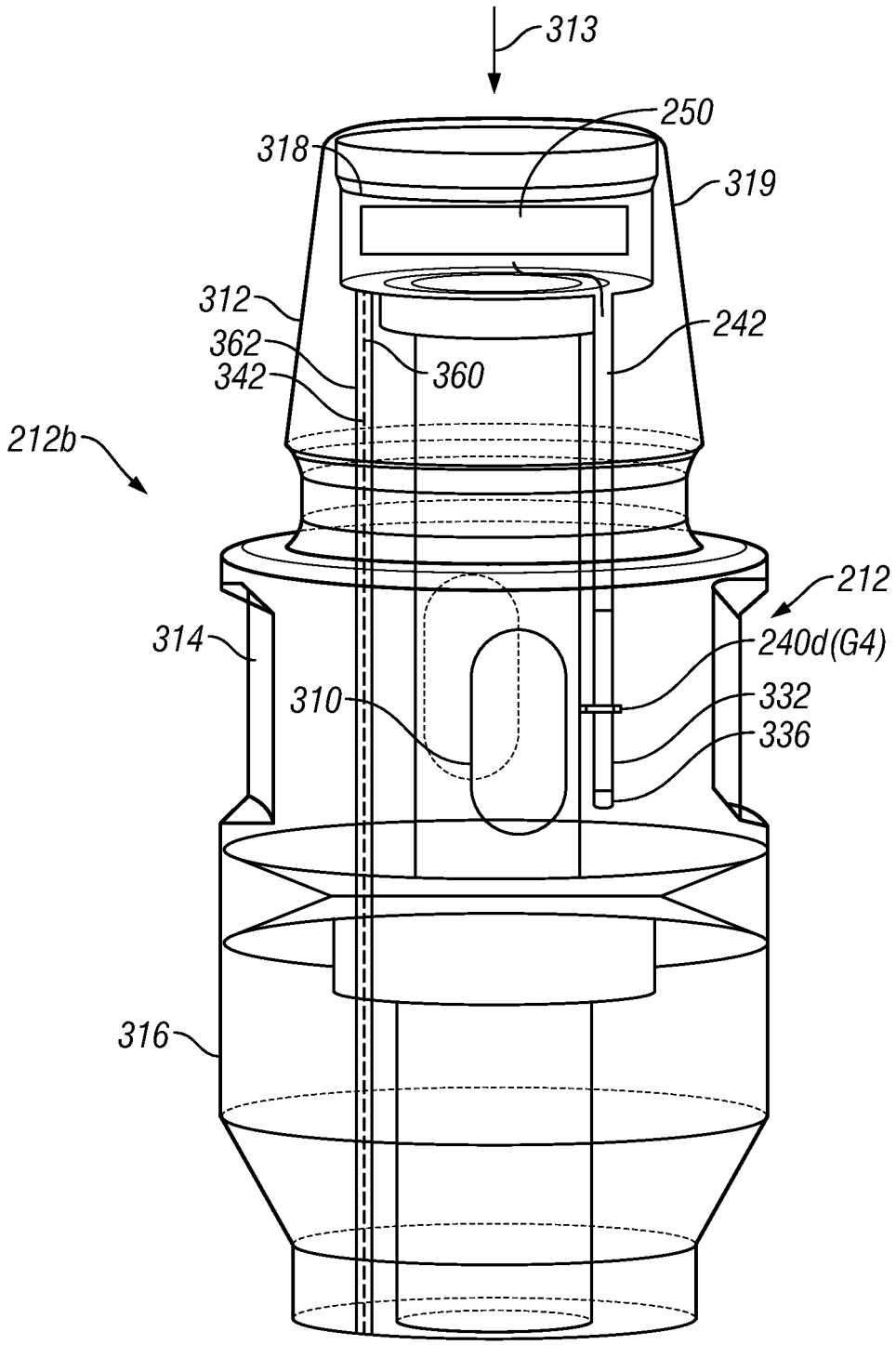
FIG. 3 is an isometric line diagram of a shank of the drill bit of FIG. 2 showing placement of an electronic circuit and communication links between the gamma sensors and the electronic circuit.

FIG. 3 shows certain details of the shank 212*b* according to one embodiment of the disclosure. The shank 212*b* includes a bore 310 therethrough for supplying drilling fluid 313 to the cone 212*a* of the drill bit 150 and one or more circular sections surrounding the bore 310, such as a neck section 312, a recesses section 314 and a circular section 316. The upper end of the neck section 312 includes a recessed area or recess 318. Threads 319 on the neck section 312 connect the drill bit 150 to the drilling assembly 130 (FIG. 1). The sensor 240*d* (G4) may be placed at any suitable location in the shank. In one aspect, the sensor G4 may be placed in a recess 336 in section 314 of the shank. Conductors 242 may be run from the sensor G4 to the electric circuit 250 in the recess 318 via a channel 334 made in the shank 212. The circuit 250 may be sealed from the environment. Conductors, such as conductor 360 placed in a cavity 362, may be utilized to communicate signals from the sensors G1-G3 in the cone section to the circuit 250. The circuit 250 may be coupled to the downhole controller 170 (FIG. 1) by communication links that run from the circuit 250 to the controller 170. In one aspect, the circuit 250 may include an amplifier that amplifies the signals from the sensors G4 and an analog-to-digital (A/D) converter that digitizes the amplified signals (collectively designated by 251). Circuit 250 may further include a processor 252 (such as microprocessor) configured to process signals from the D/A converter, a data storage device 254 (such as solid state memory device) configured to store data and programs (instructions) 256 accessible to the processor 252. Communication between the drill bit 150 and the controller 170 may be provided via direct connections, acoustic telemetry or any other suitable method. Power to the electrical circuit 250 may be provided by a battery or by a power generator in the BHA 130 (FIG. 1) via electrical conductors. In another aspect, the sensor signals may be digitized without prior amplification.

In one aspect, a bit-based gamma ray sensor configured to detect naturally-occurring gamma rays may provide an early indication, or even a first indication, of a lithology or change in lithology in the vicinity of the bit body 150. In embodiments, the signals from the bit-based gamma ray sensors may be utilized to estimate an energy signature for the formation being drilled. Thereafter, the detected energy signature may be compared to or correlated with the energy signatures from reference formations having a known lithology. This comparison or correlation may be used to estimate or predict the lithology of the formation being drilled. In one embodiment, the sensor package 240 may provide the primary measurements from which a lithology or a change in lithology may be estimated. In other embodiments, the measurements provided by the sensor package 240 may be utilized in conjunction with the measurements provided by the formation evaluation sensors of the MWD system 170 to estimate a lithological characteristic or a change in a lithological characteristic. Analysis of passive gamma rays provides differentiation between different types of rocks, such as shale and sand. The estimated properties of the formation may be utilized to alter one or more drilling parameters. Sand is far harder than shale. Therefore, when a drill bit moves, for example, from shale to sand, the driller, using information provided by gamma ray analysis, may opt to increase weight on bit and/or reduce a rotational speed of the drill bit. In the same manner, when moving from sand to shale, the driller may opt to alter the drilling parameters to obtain a higher rate of penetration.

Figure 4:
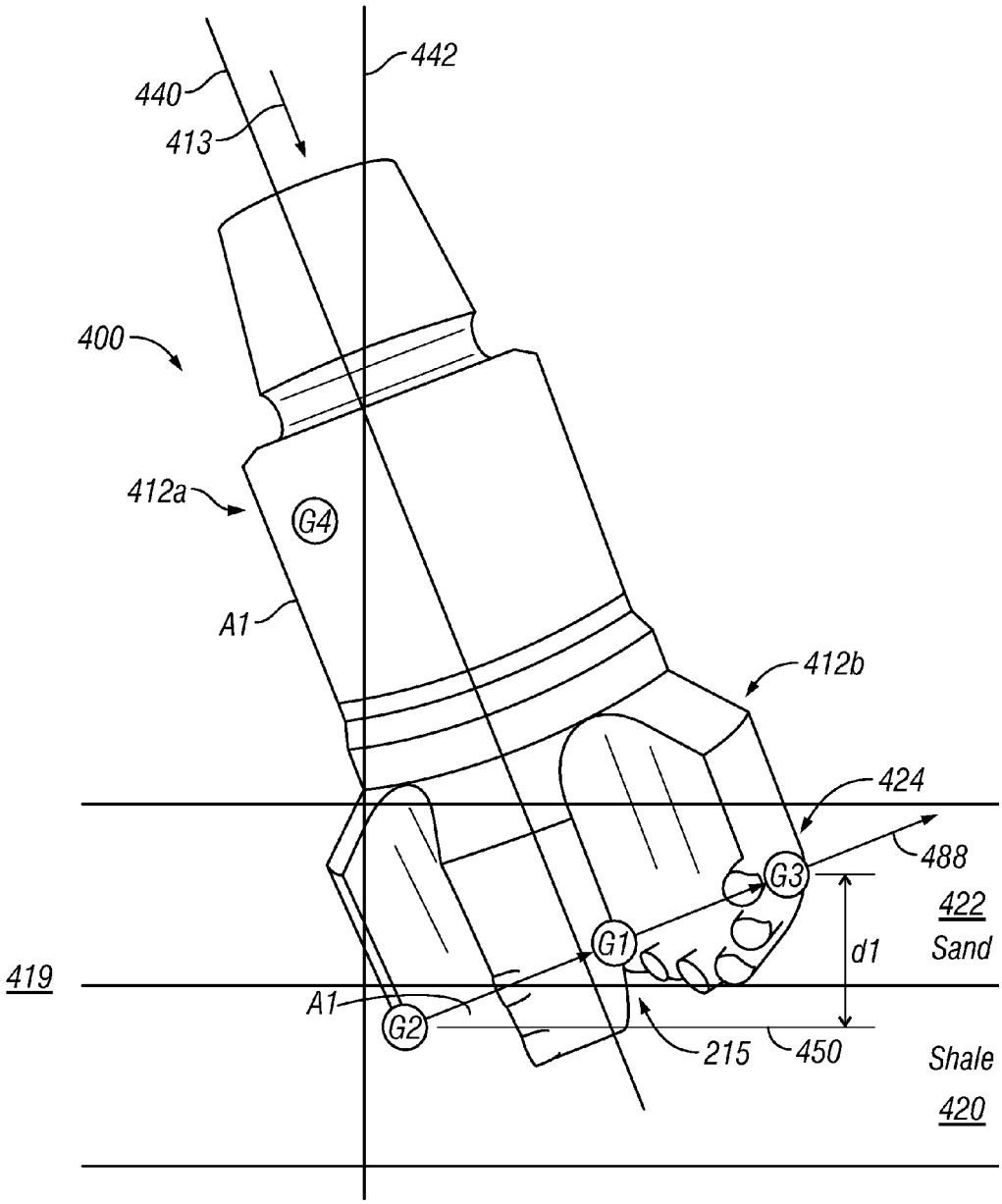
FIG. 4 shows a drill bit fitted with the gamma sensors, when the drill bit is moving from a sand formation to a shale formation at an inclination.

FIG. 4 shows an exemplary drill bit 400 moving from sand 422 to shale 420 in the course of drilling through the formation 419. The exemplary drill bit 400 includes a gamma ray sensor G1 at the center 215 and gamma ray sensors G2 and G3 at the cone 424. Gamma ray sensors G1-G3 are in a common plane 488, substantially perpendicular to the drill bit longitudinal axis 440. The drill bit axis 440 is shown inclined to the vertical 442 by an angle A1 (also referred to as the inclination or tilt). The angle between a plane 488 perpendicular (orthogonal) to the vertical 442 is the same as the tilt A1. During drilling, sensors G1, G2 and G3 come in contact with the formation 419 and each such sensor provides signals representative of the gamma rays detected from the formation by such sensor. Sensor G4 is in contact with the drilling fluid 413 flowing through the drill bit 400. As previously noted, G4 detects gamma rays mainly from the drilling fluid 413. The signals from sensor G4 may be used as reference signals. If the drill bit is drilling a vertical hole (i.e. the axis 440 coincides with the vertical axis 442), each of the sensors G1-G3 will detect gamma rays from the same formation and provide the same measurement. In aspects, the sensors G1-G3 may be calibrated relative to the tilt at the surface and such data stored in downhole and/surface data storage devices. However, if the drill bit is tilted, such as the tilt demonstrated by an angle A1 and as the drill bit 400 advances from one formation to another, such as from sand to shale, the sensor G2 will enter shale 420 first and detect gamma rays from shale while sensor G3 will still provide signals relating to sand 422. By differentiating the measurements between sensor G1 and sensor G2, discrimination between different signals can be enhanced. If the drill bit 400 and thus all the sensors G1-G3 are in the same rock (for example sand or shale), sensors G1-G3 will provide same or substantially the same measurements. As the drill bit 400 approaches the shale and sand interface or boundary 430 during drilling operations, sensors G1-G3 provide different gamma ray measurements. From the magnitude intensity of G1 and G2 or G1 and G4, the offset height of each such sensor relative to the bed boundary 430 or a plane parallel thereto may be determined. Since the distances between sensors G1, G2 and G3 are known, the tilt angle or inclination A1 can be computed.

In the drill bit 400, let the known distance between sensors G2 and G3 be d(G2-G3). The vertical distance d1 between G2 and G3 may be computed by comparing the measurements from G2 and G3 with laboratory calibration data performed at the surface. The calibration data, in one aspect, may include data for the G2 and G3 sensors obtained for shale, sand and other rocks. The data may be presented as API count rates for the measurements of such sensors and the various tilt angles. Such calibration data may be stored in a storage device in the circuit 250 (FIG. 2) controller 170 and/or 190 (FIG. 1). The actual sensor measurements converted into API counts may be correlated to the calibration API counts to determine the tilt. Thus the comparison of the API count corresponding to actual gamma ray sensor G3 measurements with the calibration API count provides the distance d(G3))=d1 of the sensor G3. When the sensors G2 and G3 are on the same horizontal plane (drilling a vertical hole) the distance d1=zero, because API count for G2=API count for G3. When the drill bit is at an angle to the line 442, such as angle A1, and the drill bit 400 is moving from sand to shale, then API(G2)>API(G3). A procedure to determine the tilt A1 may involve: When the API (G2) is greater than or equal to API(G3), read API(G3); check to see if API(G2)=API(G3); if no, convert API(G3) to distance to shale line using the calibration data. The formula may be Sine A1=distance of G4 from shale line divided by distance between G2 and G3, which is known from the actual placement of the G2 and G3 in the drill bit 400.

Referring to FIGS. 1-4, during drilling, signals from the sensors G1-G4 may be sent to the circuit 250 (FIG. 2) for processing. The processed signals from circuit 250 may be sent to the controller 170. Controller 170 may process signals received from circuit 250 to determine the tilt angle A1. In another aspect, some or all of the signals from the circuit 250 or controller 170 may be processed by the controller 190 to determine tilt in real or substantially real time. In one aspect, the controller 170, controller 190 and/or an operator may control one or more drilling parameters based at least in part on computed inclination. For instance, the processor 172 may be configured to send commands to alter the weight-on-bit or alter rotational speed of the drill bit 150. Such commands may be issued, for example, to reduce WOB or RPM because a relatively hard layer lies ahead of the drill bit. In another instance, the command may be to increase WOB or RPM because a relatively soft formation layer lies ahead of the drill bit 150. Stated generally, drilling personnel and/or the surface/downhole control devices may initiate changes to the drilling parameters to optimally drill a given formation as the drilling assembly 130 enters that formation. Such changes may include, but are not limited to, altering weight-on-bit, rotational speed of the drill bit, and the rate of the fluid flow so as to increase the efficiency of the drilling operations and extend the life of the drill bit 150 and drilling assembly 130. Early implementation of adjustments to drilling parameters may provide more efficient drilling and extend the life of the drill bit 150 and/or BHA.

Thus, in one aspect, an apparatus for use in drilling a wellbore in a formation is provided, which apparatus in one embodiment includes a bit body having a longitudinal axis, a plurality of gamma ray sensors placed in the bit body in a common plane at an angle to the longitudinal axis of the bit body, each such gamma ray sensor in the plurality of sensors configured to detect gamma rays from the formation during drilling of the wellbore and to provide signals representative of the detected gamma rays; and a circuit configured to process at least partially the signals from the plurality of gamma ray sensors for estimating an inclination of the bit body relative to the longitudinal axis. In another aspect, at least two sensors in the plurality of sensors are placed in a cone section the bit body, wherein the at least two sensors are in a common plane substantially perpendicular to the longitudinal axis. In another aspect, calibration data relating to determining tilt based on the measurements from the plurality of sensors is accessible to the circuit for estimating the tilt or inclination. In another aspect, the circuit is placed in a recess in a neck of the bit body and is sealed from the external environment. In another aspect, the apparatus includes a processor, wherein the processor is configured to process the measurements from the at least two sensors in whole or in part to estimate the tilt. In another aspect, the bit body is attached to bottomhole assembly.

In another aspect, a method for drilling a wellbore is provided, which method in one embodiment may include: drilling a wellbore in a formation using a drill bit including at least two gamma ray sensors; obtaining measurements from the at least two gamma ray sensors relating to detection of gamma rays in the formation; and estimating an inclination of the drill bit using the measurements of the at least two gamma ray sensors. In another aspect, the method may include altering a drilling parameter at least in part based on the estimated inclination.

The foregoing description is directed to particular embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

The invention claimed is:

1. A drill bit, comprising:

a longitudinal axis; and a plurality of gamma ray sensors placed spaced apart in the drill bit in a common plane at an angle to the longitudinal axis, the plurality of gamma ray sensors including at least a first gamma ray sensor proximate a center of a cone of the drill bit and a second gamma ray sensor placed on a first side of the cone, wherein each gamma ray sensor is configured to detect gamma rays from a formation during drilling of a wellbore and provide signals representative of the detected gamma rays for use in estimating inclination of the drill bit relative to a formation boundary during drilling of the wellbore.

2. The drill bit of claim 1, wherein the plurality of gamma ray sensors further comprises a third gamma ray sensor placed on a second side of the cone.

3. The drill bit of claim 2, wherein the first gamma ray sensor, second gamma ray sensor and third gamma ray sensor are along a substantially straight line in the common plane.

4. The drill bit of claim 1, wherein the angle is substantially perpendicular to the longitudinal axis of the drill bit.

5. The drill bit of claim 1 further comprising a circuit in the drill bit configured to at least partially process the signals from the plurality of gamma ray sensors for estimating inclination of the drill bit relative to the formation boundary.

6. The drill bit of claim 5, wherein the circuit determines a count rate from the signals of each gamma ray sensor in the plurality of sensors and compares such determined count rates to calibration data accessible to the circuit for determining the inclination of the drill bit.

7. The drill bit of claim 5, wherein the circuit is placed in a recess in a neck of the drill bit and the circuit is sealed from an external environment.

8. The drill bit of claim 5, wherein the circuit includes a processor configured to at least partially process the signals from the plurality of sensors for determining inclination of the drill bit to estimate the inclination.

9. The drill bit of claim 1, wherein a gamma ray sensor in the plurality of gamma ray sensors is configured to detect gamma rays from a fluid flowing through the drill bit during drilling of the wellbore.

10. The drill bit of claim 9 further comprising a circuit configured to normalize measurements of at least two gamma ray sensors in the plurality of gamma ray sensors using measurements from the gamma rays detected from the fluid flowing through the drill bit.

11. The drill bit of claim 10, wherein the circuit is further configured to determine a vertical distance between two gamma ray sensors in the plurality of gamma ray sensors using count rates determined from the signals provided by such two gamma ray sensors.

12. The drill bit of claim 11, wherein the circuit is configured to determine the inclination of the drill bit using the determined vertical distance.

13. An apparatus for use in drilling a wellbore in a formation, comprising:

a drill bit having a cone and a longitudinal axis;

at least two gamma ray sensors placed spaced-apart in the cone of the drill bit in a plane at an angle to the longitudinal axis, the at least two gamma ray sensors including at least a first gamma ray sensor proximate a center of a cone of the drill bit and a second gamma ray sensor placed on a first side of the cone, wherein each gamma ray sensor is configured to detect gamma rays from the formation in front of such sensor during drilling of the wellbore and to provide signals corresponding to the detected gamma rays; and a circuit configured to process the signals from the at least two gamma ray sensors to estimate an inclination of the drill bit relative to a formation boundary.

14. The apparatus of claim 13, wherein the at least two sensors are in a common plane that is substantially perpendicular to the longitudinal axis.

15. The apparatus of claim 13, wherein the circuit is configured to estimate the inclination by correlating information deduced from the signals from the at least two gamma ray sensors with inclination calibration data provided to the circuit.

16. The apparatus of claim 13, wherein the circuit is sealingly placed in a recess in a neck of the drill bit.

17. The apparatus of claim 13 further comprising a drilling assembly attached to the drill bit.

18. The apparatus of claim 17, wherein the circuit includes a processor configured to process the measurements from the at least two sensors to estimate the inclination.

19. A method of drilling a wellbore, comprising:

drilling a wellbore in a formation using a drill bit having a plurality of gamma ray sensors in the drill bit, the plurality of gamma ray sensors including at least a first gamma ray sensor proximate a center of a cone of the drill bit and a second gamma ray sensor placed on a first side of the cone;

obtaining measurements from each of the plurality of gamma ray sensors relating to detection of gamma rays from the formation; and estimating an inclination of the drill bit using the measurements from the plurality of gamma ray sensors.

20. The method of claim 19 further comprising altering a drilling parameter at least in part based on the estimated inclination.

21. The method of claim 19, wherein estimating the inclination comprises correlating the measurements from the plurality of sensors with predefined calibration data for the drill bit.

22. The method of claim 19 further comprising:

determining an occurrence of change in the formation using the measurements from the plurality of gamma ray sensors; and altering a drilling parameter in response to the determination of the occurrence of change in the formation.

23. A method of providing a drill bit for use in determining inclination of the drill bit during drilling of a wellbore, comprising:

providing the drill bit having a cone and a longitudinal axis; and placing a plurality of gamma ray sensors in the cone in a in a common plane that is at a selected angle to the longitudinal axis, the plurality of gamma ray sensors including at least a first gamma ray sensor proximate a center of a cone of the drill bit and a second gamma ray sensor placed on a first side of the cone, wherein each gamma ray sensor is configured to detect gamma rays from a formation during drilling of the wellbore and provide signals representative of the detected gamma rays for use in estimating the inclination of the drill bit relative to a formation boundary during drilling of the wellbore.

24. The method of claim 23, wherein the plurality of gamma ray sensors further comprises a third gamma ray sensor placed on a second side of the cone.

25. The method of claim 24, wherein the first, second and third gamma ray sensors are substantially along a straight line in the common plane.

* * * * *